US012290131B2

(12) United States Patent
Hamoud et al.

(10) Patent No.: US 12,290,131 B2
(45) Date of Patent: May 6, 2025

(54) BEANIE H STITCH

(71) Applicants: Karar Hadib Hamoud, Cleveland, OH (US); Haidar Hadib Hamoud, Cleveland, OH (US); Aisar Hadib Hamoud, Cleveland, OH (US); Ali Hadib Hamoud, Cleveland, OH (US)

(72) Inventors: Karar Hadib Hamoud, Cleveland, OH (US); Haidar Hadib Hamoud, Cleveland, OH (US); Aisar Hadib Hamoud, Cleveland, OH (US); Ali Hadib Hamoud, Cleveland, OH (US)

(73) Assignee: Hoakwear, LLC, Cleveland, OH (US)

( * ) Notice: Subject to any disclaimer, the term of this patent is extended or adjusted under 35 U.S.C. 154(b) by 32 days.

(21) Appl. No.: 18/342,548

(22) Filed: Aug. 28, 2023

(65) Prior Publication Data

US 2025/0072547 A1 Mar. 6, 2025

(51) Int. Cl.
*A42C 1/00* (2006.01)
*A42B 1/04* (2021.01)

(52) U.S. Cl.
CPC . *A42C 1/00* (2013.01); *A42B 1/04* (2013.01)

(58) Field of Classification Search
CPC .. A42C 1/00; A42B 1/04; D05B 97/00; D05B 93/00
USPC ..... D2/889
See application file for complete search history.

(56) References Cited

U.S. PATENT DOCUMENTS

| | | | | | |
|---|---|---|---|---|---|
| 1,421,602 | A * | 7/1922 | Spector | A42B 1/208 | 66/171 |
| 1,906,212 | A * | 4/1933 | Lacks | D04B 1/24 | 66/189 |
| 3,169,252 | A * | 2/1965 | Goldstein | A42B 1/046 | 2/203 |
| 4,620,325 | A * | 11/1986 | Hatfield | A42B 1/04 | 2/195.1 |
| D340,344 | S * | 10/1993 | McPherson | D2/866 | |
| D654,252 | S * | 2/2012 | Denny | D2/887 | |
| D794,916 | S * | 8/2017 | Wright | D2/867 | |
| 2020/0196695 | A1 * | 6/2020 | Ault | A42B 1/225 | |

* cited by examiner

*Primary Examiner* — Ismael Izaguirre

(57) ABSTRACT

This invention introduces a groundbreaking beanie design featuring a new stitch configuration, departing from conventional norms. Employing innovative stitch lining techniques, the crown of the beanie is artistically redefined, blending comfort with sophistication. The distinctive design involves two parallel vertical stitches interconnected by a solitary horizontal stitch, evoking the form of the letter "H" or the Greek letter Theta. The stitch lines exhibit fluidity, adapting seamlessly to fabric stretch when worn. This versatile stitch pattern is adaptable to both cuffless and cuffed beanies, signifying a versatile solution for diverse preferences. The invention revolutionizes beanie creation while accentuating the convergence of textile artistry and wearable functionality.

1 Claim, 5 Drawing Sheets

FRONT OF BEANIE

TOP OF BEANIE

SIDE OF BEANIE

INSIDE STITCH OF BEANIE

BEANIE H STITCH

CROSS-REFERENCE TO RELATED APPLICATIONS

Figure 1:
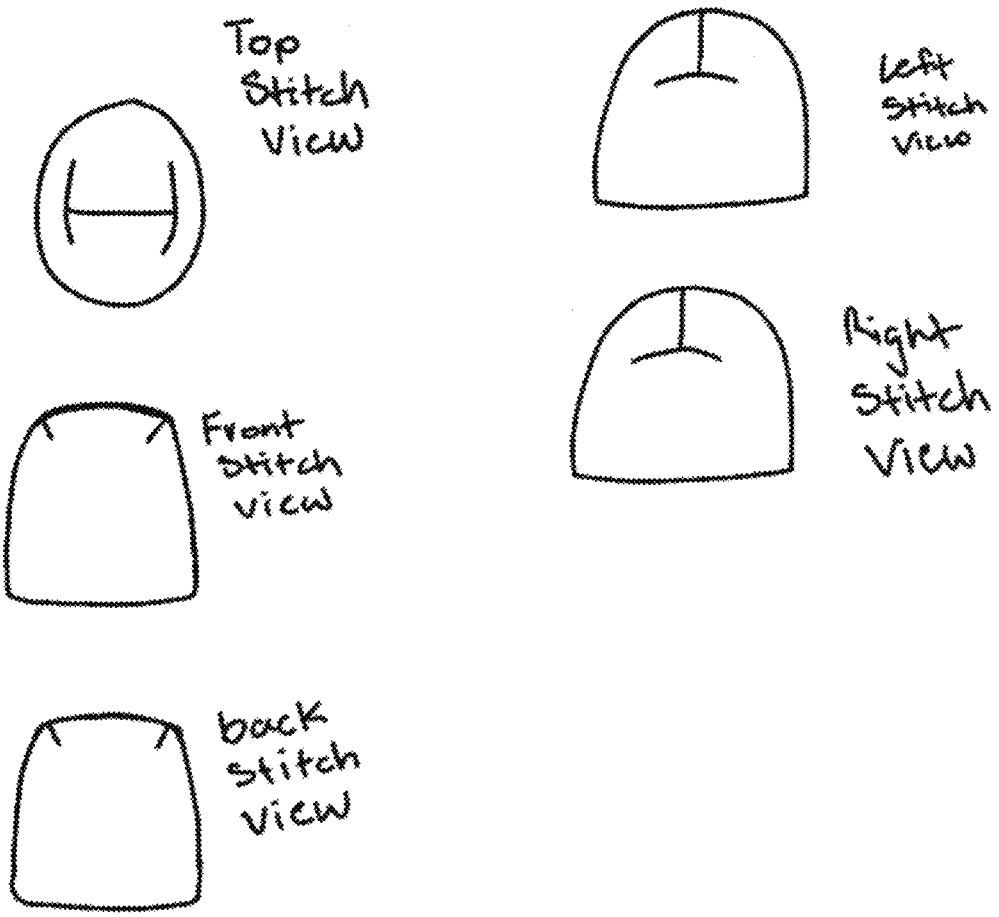
Figure 2:
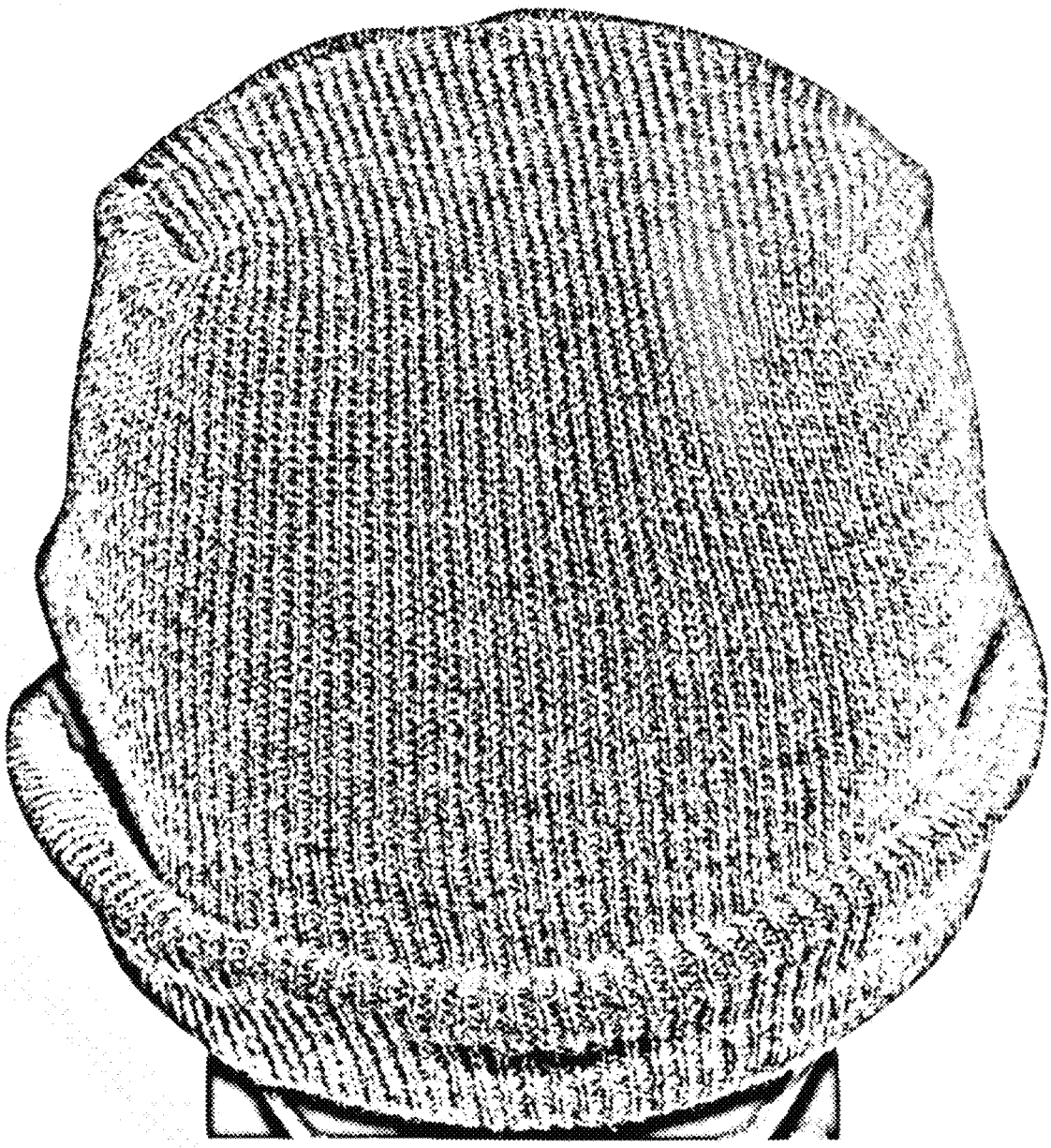
Figure 3:
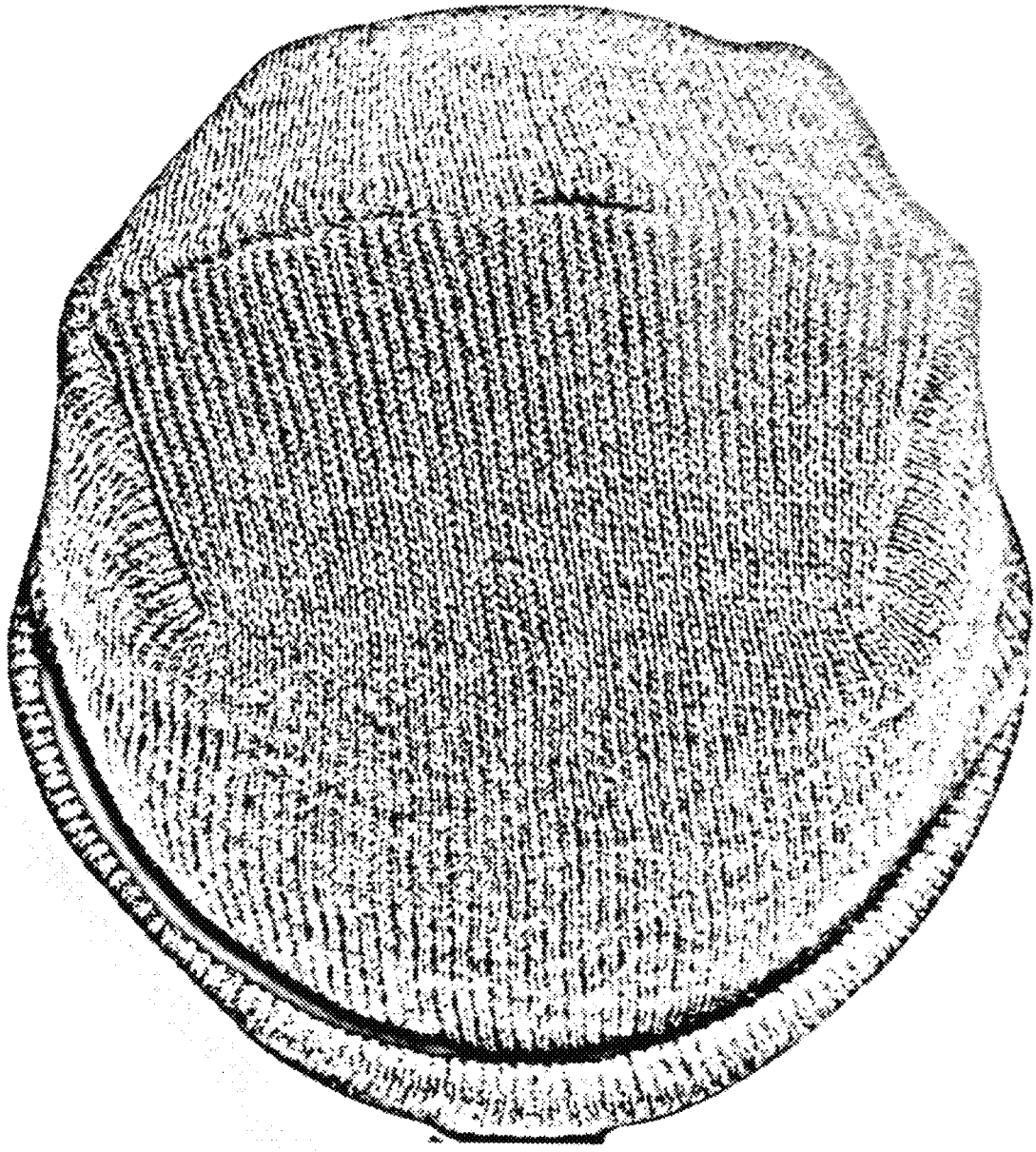
Figure 4:
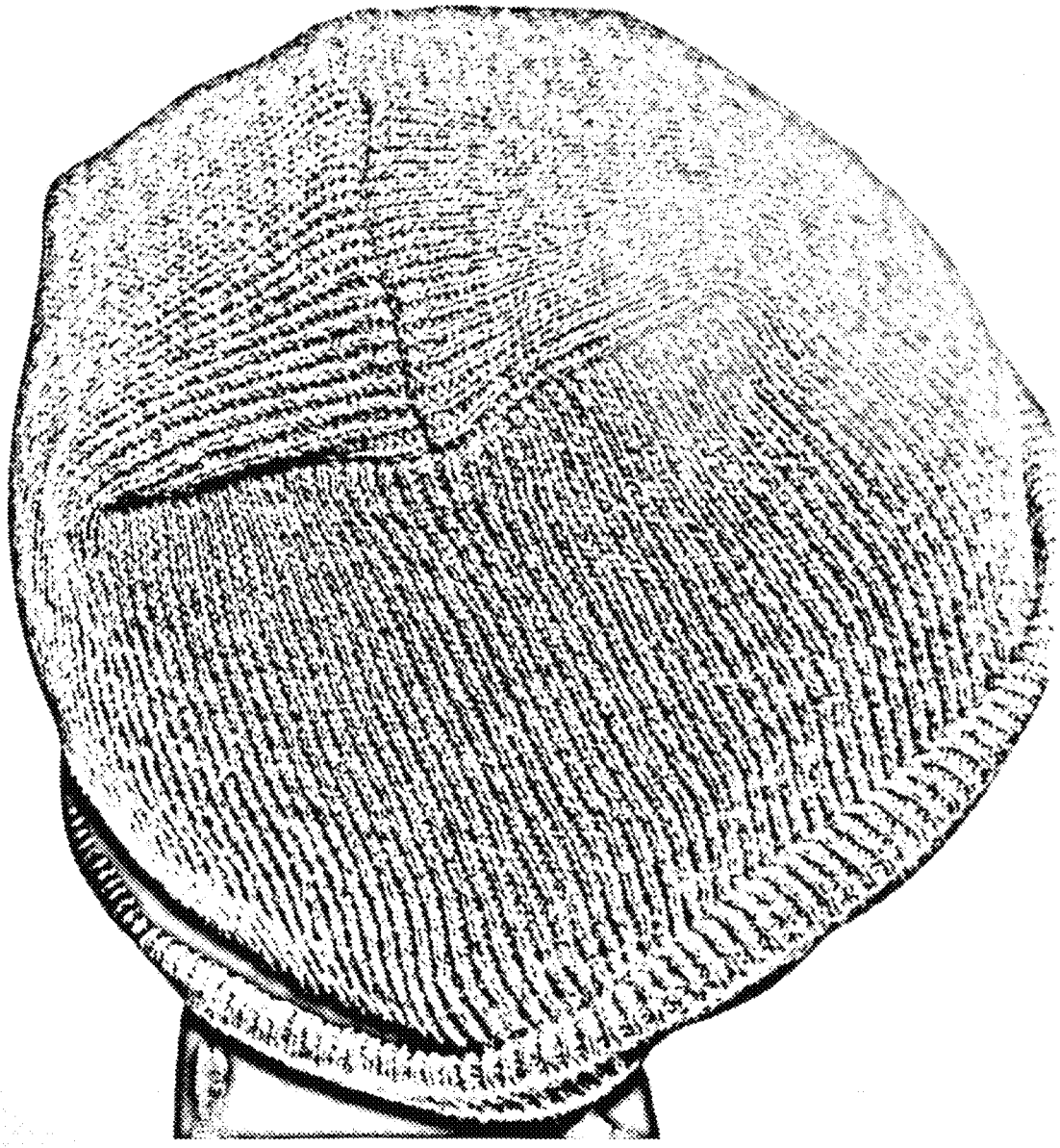
Figure 5:
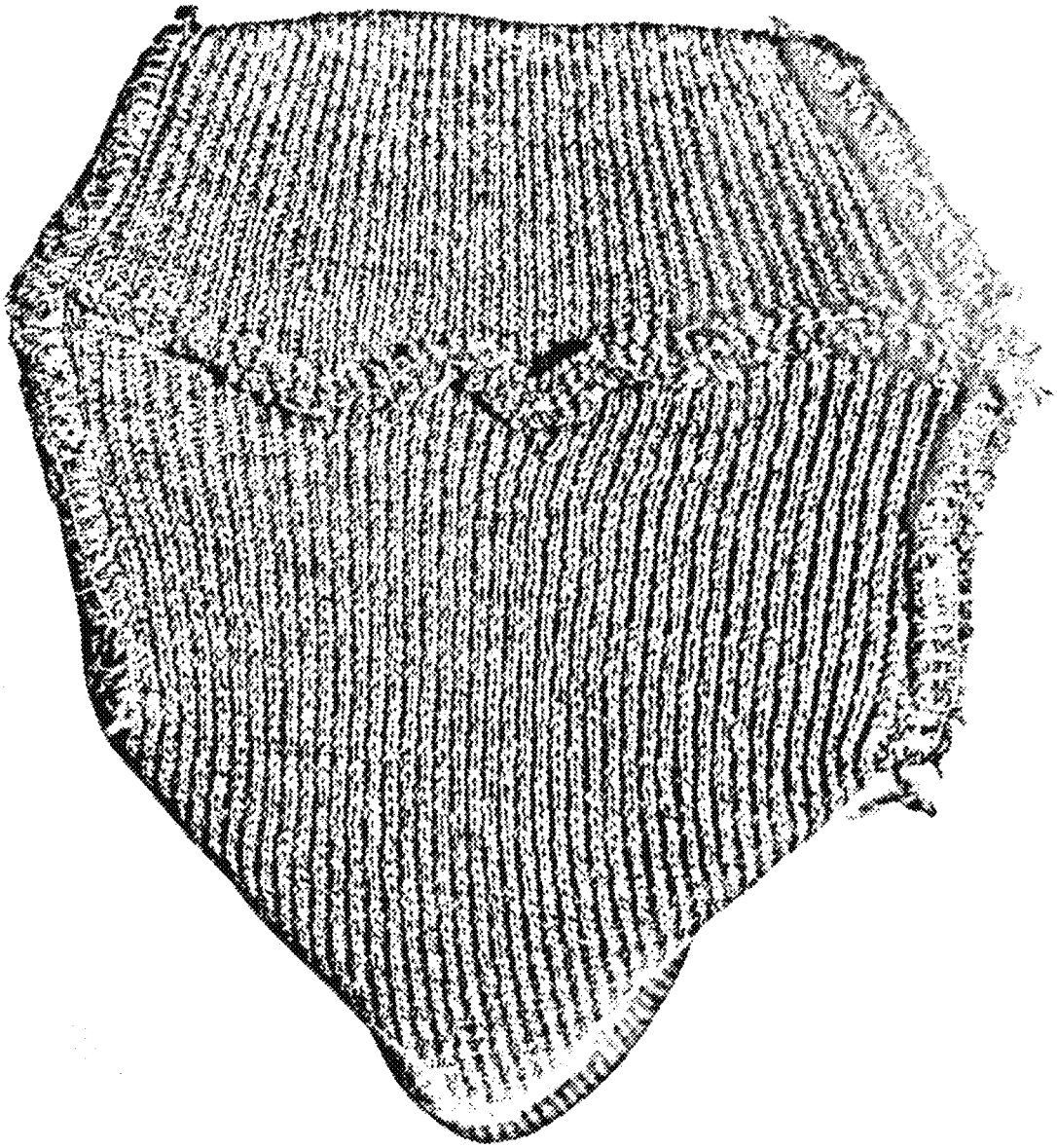

Ser. No. 18/342,548 and Ser. No. 29/878,778 Filed on Jun. 27, 2023.

BACKGROUND OF THE INVENTION

The invention pertains to the fields of invention of clothing, garments, headwear, and apparel. The invention seeks to create a streamline and comfortable fit that differs from the current beanie stitch that is being used. The beanie H stitch's aim is to create a contoured fit to the crown of the head which allows a new take on comfort using the spacing and placement of the stitch at the peak or crown of the beanie.

Description of Related Art: Including Information Disclosed Under 37 CFR 1.97 and 1.98

The related art depicts figures of the beanie and stitch design showcasing vertical parallel stitches connected by one horizontal stitch, creating the appearance of the English letter "H." The vertical stitches are located only at the peak of the crown and do not extend beyond that. The related art showcases different angles of the beanie, illustrating the stitch from multiple viewpoints.

BRIEF SUMMARY OF THE INVENTION

A beanie whose stitch alters from a traditional beanie. Its stitching components consist of two vertical parallel stitches connected by one horizontal stitch.

BRIEF DESCRIPTION OF THE SEVERAL VIEWS OF THE DRAWING(S)

FIG. 1 shows:

5 hand rendered drawings of a beanie from alternating viewpoints titled: top stitch view, front stitch view, back stitch view, left stitch view, and right stitch view.

FIG. 2 shows:

A black and white photograph of the front of the beanie showcasing the horizontal stitch running along the top.

FIG. 3 shows:

A black and white photograph of the top of the beanie showcasing the full stitch pattern in the shape of two vertical lines connected by one horizontal line in which the spacing between vertical line 1 and vertical line 2 varies.

FIG. 4 shows:

A black and white photograph of the side of the beanie showcasing the side view of the stitch on the beanie.

FIG. 5 shows:

A black and white photograph of the inside of the beanie showcasing the stitch linings in the "H" design.

DETAILED DESCRIPTION OF THE INVENTION

The invention showcases a new beanie design stitch. It uses stitch lining techniques to outline the crown of the head in a way that is comfortable and sleek. This new design uses two vertical parallel stitches connected by one horizontal stitch. This forms the appearance of the letter "H", or it may form the appearance of the Greek letter Theta. The lines may curve according to the stretch of the fabric/beanie when worn. This stitch may or may not be used on beanies with or without a cuff.

The invention claimed is:

1. The method for creating a beanie using the stitch, comprising of the steps:

Forming two vertical parallel stitches and connecting the two vertical parallel stitches with one horizontal stitch, creating an appearance resembling the letter "H", this includes varying the spacing between the two vertical parallel stitches to accommodate the stretch of the fabric/beanie when worn, this may be on beanies with or without a cuff. The parallel stitches do not extend to the brim of the beanie but rather sit at the crown of the head, at the peak and are bridged with a singular stitch.

* * * * *